US007243745B2

(12) United States Patent
Skeem et al.

(10) Patent No.: US 7,243,745 B2
(45) Date of Patent: Jul. 17, 2007

(54) CUTTING ELEMENTS AND ROTARY DRILL BITS INCLUDING SAME

(75) Inventors: Marcus R. Skeem, Sandy, UT (US); Danny E. Scott, Montgomery, TX (US); Jeffrey B. Lund, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 64 days.

(21) Appl. No.: 10/901,836

(22) Filed: Jul. 28, 2004

(65) Prior Publication Data

US 2006/0021802 A1 Feb. 2, 2006

(51) Int. Cl.
*E21B 1/36* (2006.01)
*E21B 10/36* (2006.01)

(52) U.S. Cl. ..... 175/432; 175/434; 175/431

(58) Field of Classification Search ..... 175/432, 175/428, 426, 431, 434
See application file for complete search history.

(56) References Cited

U.S. PATENT DOCUMENTS

| | | | | |
|---|---|---|---|---|
| 4,109,737 | A | 8/1978 | Bovenkerk | |
| RE32,036 | E | 11/1985 | Dennis | |
| 4,558,753 | A | 12/1985 | Barr | |
| 4,593,777 | A | 6/1986 | Barr | |
| 4,604,106 | A | 8/1986 | Hall et al. | |
| 4,660,659 | A | 4/1987 | Short, Jr. et al. | |
| 4,679,639 | A | 7/1987 | Barr et al. | |
| 4,764,434 | A | 8/1988 | Aronsson et al. | |
| 4,811,801 | A | 3/1989 | Salesky et al. | |
| 4,858,707 | A | 8/1989 | Jones et al. | |
| 4,987,800 | A | 1/1991 | Gasan et al. | |
| 4,997,049 | A | 3/1991 | Tank et al. | |
| 5,016,718 | A | 5/1991 | Tandberg | |
| 5,120,327 | A | 6/1992 | Dennis | |
| 5,154,245 | A | 10/1992 | Waldenstrom et al. | |
| 5,158,148 | A | 10/1992 | Keshavan | |
| 5,248,006 | A | 9/1993 | Scott et al. | |
| 5,273,125 | A | 12/1993 | Jurewicz | |
| 5,304,342 | A | 4/1994 | Hall, Jr. et al. | |
| 5,335,738 | A | 8/1994 | Waldenstrom et al. | |
| 5,351,772 | A | 10/1994 | Smith | |
| 5,355,969 | A * | 10/1994 | Hardy et al. | 175/432 |
| 5,379,854 | A | 1/1995 | Dennis | |

(Continued)

FOREIGN PATENT DOCUMENTS

| | | |
|---|---|---|
| EP | 0 356 097 B1 | 11/1994 |

(Continued)

*Primary Examiner*—William Neuder
*Assistant Examiner*—Nicole A Coy
(74) *Attorney, Agent, or Firm*—TraskBritt

(57) ABSTRACT

A cutting element for a rotary drill bit that has a superabrasive member joined to a substrate at a three-dimensional interface is disclosed. The interface of the cutting element preferably incorporates a first ring pattern comprising a plurality of circumferentially arranged raised sections which are separated by a plurality of radially extending grooves. Also, the interface configuration may include at least a second ring pattern comprising a plurality of circumferentially arranged raised sections which are separated by a plurality of radially extending grooves. Radially adjacent ring patterns may substantially circumferentially overlap with one another. An interface of a cutting element including at least one ring pattern having an odd number of sections is also disclosed. Further, rotary drill bits including at least one such cutting element are disclosed.

54 Claims, 9 Drawing Sheets

U.S. PATENT DOCUMENTS 5,435,403 A 7/1995 Tibbitts
5,437,343 A 8/1995 Cooley et al.
5,460,233 A 10/1995 Meany et al.
5,472,376 A 12/1995 Olmstead et al.
5,484,330 A 1/1996 Flood et al.
5,486,137 A 1/1996 Flood et al.
5,494,477 A 2/1996 Flood et al.
5,499,688 A 3/1996 Dennis
5,544,713 A 8/1996 Dennis
5,566,779 A 10/1996 Dennis
5,590,728 A 1/1997 Matthias et al.
5,590,729 A 1/1997 Cooley et al.
5,605,199 A 2/1997 Newton
5,617,928 A 4/1997 Matthias et al.
5,647,449 A 7/1997 Dennis
5,649,604 A 7/1997 Fuller et al.
5,706,906 A 1/1998 Jurewicz et al.
5,709,279 A 1/1998 Dennis
5,711,702 A 1/1998 Devlin
5,758,733 A 6/1998 Scott et al.
5,823,277 A 10/1998 Delwiche et al.
5,862,873 A 1/1999 Matthias et al.
5,871,060 A 2/1999 Jensen et al.
5,875,862 A * 3/1999 Jurewicz et al. ..... 175/432
5,887,580 A 3/1999 Eyre
5,890,552 A 4/1999 Scott et al.
5,906,246 A 5/1999 Mensa-Wilmot et al.
5,928,071 A 7/1999 Devlin
5,967,249 A 10/1999 Butcher
5,971,087 A 10/1999 Chaves
6,003,623 A 12/1999 Miess
6,026,919 A 2/2000 Thigpen et al.
6,041,875 A 3/2000 Rai et al.
6,065,554 A 5/2000 Taylor et al.
6,068,071 A 5/2000 Jurewicz
6,082,474 A 7/2000 Matthias
6,135,219 A 10/2000 Scott
6,189,634 B1 2/2001 Bertagnolli et al.
6,196,340 B1 3/2001 Jensen et al.
6,199,645 B1 3/2001 Anderson et al.
6,202,771 B1 3/2001 Scott et al.
6,227,319 B1 5/2001 Radford
6,241,036 B1 * 6/2001 Lovato et al. ..... 175/432
6,315,066 B1 * 11/2001 Dennis ..... 175/431
6,315,067 B1 11/2001 Fielder
6,408,959 B2 * 6/2002 Bertagnolli et al. ..... 175/432
6,412,580 B1 7/2002 Chaves
6,527,069 B1 3/2003 Meiners et al.
6,571,891 B1 6/2003 Smith et al.
6,739,417 B2 5/2004 Smith et al.

FOREIGN PATENT DOCUMENTS

GB 2 300 208 A 10/1996
GB 2 316 698 A 4/1998

* cited by examiner

CUTTING ELEMENTS AND ROTARY DRILL BITS INCLUDING SAME

BACKGROUND OF THE INVENTION

1. Field of the Invention

This invention relates generally to superabrasive cutting elements, inserts, or compacts, for abrasive cutting of rock and other hard materials. More particularly, the invention pertains to improved interfacial geometries for polycrystalline diamond compacts (PDCs) used in drill bits, reamers, and other downhole tools used to form a borehole in a subterranean formation.

2. Background of Related Art

Drill bits for oil field drilling, mining and other uses typically comprise a metal body into which cutting elements are incorporated. Such cutting elements, also known in the art as inserts, compacts, buttons, and machining tools, are typically manufactured by forming a superabrasive layer on the end of a sintered or cemented tungsten carbide substrate. As an example, polycrystalline diamond, or other suitable superabrasive material, such as cubic boron nitride, may be sintered onto the surface of a cemented carbide substrate under ultra-high pressure and ultra-high temperature to form a PDC, or other polycrystalline compact. During this process, a sintering aid such as cobalt may be premixed with the powdered diamond or swept from the substrate into the diamond table. The sintering aid also acts as a continuous bonding phase between the diamond table and substrate.

Because of different coefficients of thermal expansion and bulk modulus, large residual stresses of varying magnitudes, at different locations, may remain in the cutting element following cooling and release of pressure. These complex stresses are concentrated near the superabrasive table/substrate interface. Depending upon the cutting element construction, the direction of any applied forces, and the particular location within the cutting element under scrutiny, the stresses may be either compressive, tensile, shear, or mixtures thereof. In the superabrasive table/substrate interface configuration, any nonhydrostatic compressive or tensile load exerted on the cutting element produces shear stresses. Residual stresses at the interface between the superabrasive table and substrate may result in failure of the cutting element upon cooling or in subsequent use under thermal stress and applied forces, especially with respect to large-diameter cutting elements. These manufacturing-induced stresses are complex and are of a nonuniform nature and thus often undesirably place the superabrasive table of the cutting element into tension at locations along the superabrasive table/substrate interface.

During drilling operations, cutting elements may be subjected to very high forces in various directions, and the superabrasive layer may fracture, delaminate, spall, or fail due to the combination of drilling-induced stresses as well as residual stresses much sooner than would be initiated by normal abrasive wear of the superabrasive layer. Because a tendency toward premature failure of the superabrasive layer and failure at the superabrasive table/substrate interface may be augmented by the presence of high residual stresses in the cutting element, many attempts have been made to provide PDC cutting elements which are resistant to premature failure. For instance, the use of an interfacial transition layer with material properties intermediate of those of the superabrasive table and substrate is known within the art. Also, the formation of cutting elements with noncontinuous grooves or recesses in the substrate filled with superabrasive material is also practiced, as are cutting element structures having interfacial concentric circular grooves or a spiral groove.

The patent literature reveals a variety of cutting element designs in which the superabrasive table/substrate interface is three dimensional, i.e., the superabrasive layer and/or substrate have portions which protrude into the other member.

U.S. Pat. No. 5,351,772 of Smith shows various patterns of radially directed interfacial structures on the substrate surface; the formations project into the superabrasive surface. More particularly, a cutting element interface having inner spokes that radially extend circumferentially between outer spokes is shown in FIG. 6A thereof.

As shown in U.S. Pat. No. 5,486,137 of Flood et al., the interfacial superabrasive surface has a pattern of unconnected radial members which project into the substrate; the thickness of the superabrasive layer decreases toward the central axis of the cutting element.

U.S. Pat. No. 5,590,728 of Matthias et al. describes a variety of interface patterns in which a plurality of unconnected straight and arcuate ribs or small circular areas characterizes the superabrasive table/substrate interface.

U.S. Pat. No. 5,605,199 of Newton teaches the use of ridges at the interface which are parallel or radial, and includes a ring of greater thickness than the remaining superabrasive table proximate the radial periphery thereof.

In U.S. Pat. No. 5,709,279 of Dennis, the superabrasive table/substrate interface is shown to be a repeating sinusoidal surface about the axial center of the cutting element.

U.S. Pat. No. 5,871,060 of Jensen et al., assigned to the assignee hereof, shows cutting element interfaces having various ovaloid or round projections. The interface surface is indicated to be regular or irregular and may include surface grooves formed during or following sintering. A cutting element substrate is depicted having a rounded interface surface with a combination of radial and concentric circular grooves formed in the interface surface of the substrate.

U.S. Pat. No. 6,026,919 of Thigpen et al. discloses, in FIG. 10 thereof a cutting element comprising concentric ring structures formed in the substrate thereof, wherein radial grooves extend from the center of the cutting element to the radial edge thereof, through each ring structure.

U.S. Pat. No. 6,315,067 of Fielder discloses, in FIG. 4 thereof, concentric ring structures formed in a substrate of a cutting element, wherein the members comprising the ring structures are substantially circumferentially aligned.

U.S. Pat. No. 6,571,891 to Smith et al., assigned to the assignee of the present invention and the disclosure of which is incorporated herein in its entirety, discloses concentric ring structures formed in a substrate of a cutting element, wherein the members comprising the ring structures are substantially circumferentially aligned. Similarly, U.S. Pat. No. 6,739,417 to Smith et al., assigned to the assignee of the present invention and the disclosure of which is incorporated herein in its entirety, discloses concentric ring structures formed in a substrate, including a substantially cylindrical PDC-type substrate having a substantially planar surface and a stud-type substrate having a generally domed surface, of a cutting element, wherein the members comprising the ring structures are substantially circumferentially aligned.

Drilling operations subject the cutting elements on a drill bit to extremely high stresses, often causing crack initiation and subsequent failure of the superabrasive table. Much effort has been devoted by the industry to making cutting elements resistant to rapid deterioration and failure.

Each of the above-indicated references, the disclosures of each of which are hereby incorporated herein, describes three-dimensional superabrasive table/substrate interfacial patterns which may ameliorate certain residual stresses in a cutting element. Nevertheless, the tendencies of the superabrasive table to fracture, defoliate, and delaminate remain. Accordingly, an improved cutting element having enhanced resistance to such stress-induced degradation is needed in the industry.

SUMMARY OF THE INVENTION

The present invention comprises a drill bit cutting element having a superabrasive table/substrate interface which provides enhanced resistance to fracture, defoliation, and delamination of the superabrasive table. The invention also provides a cutting element with a substrate and superabrasive table configuration which helps to separate, distribute, or isolate areas of residual stress within the interfacial area.

The present invention comprises a cutting element having a superabrasive layer of table overlying and attached to a substrate. The interface between the superabrasive layer and the substrate is configured to enable optimization of the nature, magnitude, and characteristics of residual stresses within the superabrasive table. The interface surface preferably incorporates a three-dimensional interface having a first ring pattern comprising a plurality of circumferentially arranged raised sections which are separated by a plurality of radially extending grooves. Also, the interface configuration includes at least a second ring pattern comprising a plurality of circumferentially arranged raised sections which are separated by a plurality of radially extending grooves. The inner raised sections may substantially circumferentially overlap with the outer grooves, while the inner grooves may substantially circumferentially overlap with the outer sections. Such a relationship between the raised sections and grooves of radially adjacent ring patterns, as used herein, is termed "substantially circumferentially misaligned."

Accordingly, the present invention contemplates a cutting element including a substrate, the interfacial surface of the cutting element having one or more smaller ring patterns formed by raised sections disposed within one or more larger ring patterns formed by raised sections, where the radially adjacent ring patterns are substantially circumferentially misaligned. The raised sections may be configured with varying geometries, as may the grooves separating the raised sections.

It should also be understood that the advantages of the present invention may be achieved by causing the interfacial surfaces as described above to form upon or within either the substrate or the superabrasive table. Since diamond powder is normally applied to the substrate prior to the ultra high pressure, ultra high temperature process of fabrication of a PDC cutting element, the substrate would normally possess the inverse of the geometry desired to be formed by the superabrasive table. Since the residual stresses that develop within the superabrasive table and carbide are, to some extent, related to one another, it would be apparent that the inverse of a particular interfacial surface may ameliorate, distribute, reduce, or increase the residual stresses that develop within both the substrate, superabrasive table, or both, in response to bonding and cooling during the manufacture of a cutting element by separating, or beneficially distributing, residual stress fields.

In a further embodiment of the present invention, the interfacial surface of the substrate or superabrasive table associated therewith may include at least one ring pattern that comprises an odd number of sections. Such a configuration may reduce symmetry and distribute symmetrical stress fields in the substrate, the superabrasive table associated therewith, or both.

Also, various constructions or definitions of radially extending grooves separating raised sections may be utilized. Moreover, the ring patterns may be concentric, non-concentric, substantially circular, ring-like, or elliptical. Further, the substrate interface surface or superabrasive interface surface may be dome-shaped, hemispherically shaped, or otherwise arcuately shaped.

The present invention also includes tools for drilling a borehole in a subterranean formation including at least one cutting element of the present invention. Particularly, the present invention contemplates that a rotary drill bit may include at least one cutting element according to the present invention. As used herein, the term "rotary drill bit" includes and encompasses full-hole bits, core bits, roller-cone bits, fixed-cutter bits, eccentric bits, bicenter bits, reamers, reamer wings, or other earth boring tools as known in the art.

BRIEF DESCRIPTION OF THE SEVERAL VIEWS OF THE DRAWINGS

The foregoing and other advantages of the present invention will become apparent upon review of the following detailed description and drawings, which illustrate various embodiments of the invention and are not necessarily drawn to scale, wherein.

DETAILED DESCRIPTION OF THE INVENTION

The several illustrated embodiments of the invention depict various features which may be incorporated into a drill bit cutting element in a variety of combinations.

The invention comprises a superabrasive cutting element 20 such as a polycrystalline diamond compact (PDC) which has a particular three-dimensional interface 38 between superabrasive, or diamond, table 12 and substrate 10. The interface 38 between the superabrasive layer or table 12 and the substrate 10 may be configured to enable optimization of the residual stresses of the superabrasive table 12 by the substrate 10.

Figure 1A:
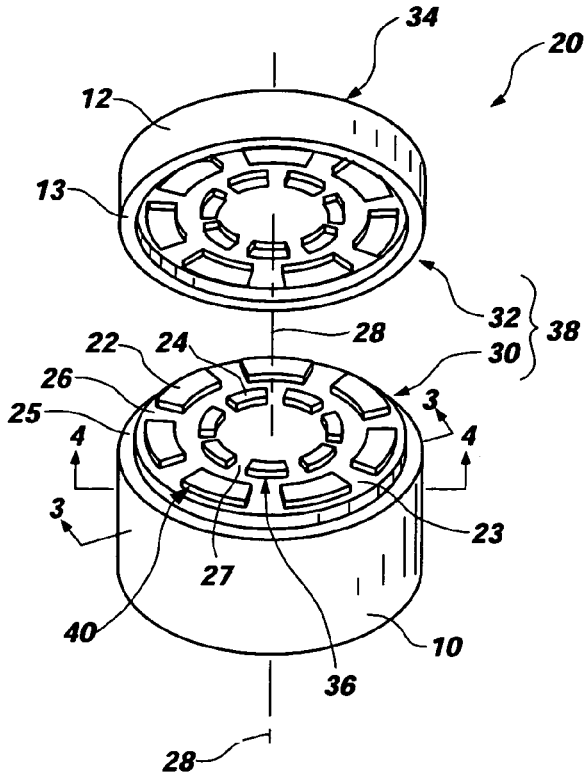
FIG. 1A is an exploded perspective view of an exemplary cutting element of the present invention.
Figure 1B:
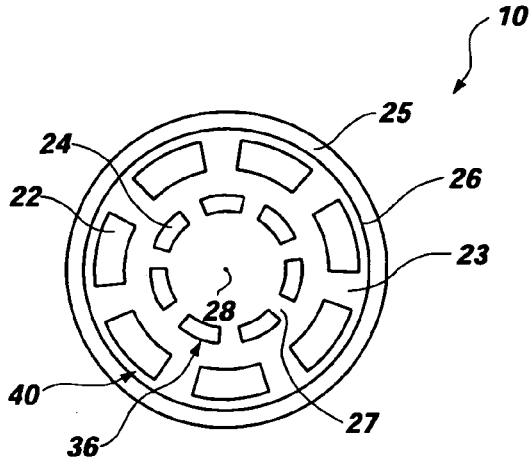
FIG. 1B is a top elevation of the exemplary cutting element shown in FIG. 1A.

As depicted in FIGS. 1A-1B, an exemplary cutting element 20 of the invention may be generally cylindrical about a central or longitudinal axis 28 thereof. Cutting element 20 may comprise a superabrasive table 12 with cutting face 34 and an interfacial surface 32, generally including complementary shaped recesses (not labeled), adjacent an interfacial surface 30 of substrate 10 that is able to withstand high applied drilling forces because of a preferable stress state and relatively high strength of mutual affixation between the superabrasive table 12 and substrate 10 provided by the present invention. The superabrasive table 12 may be formed of diamond, a diamond composite, or other superabrasive material, as known in the art. Substrate 10 may be typically formed of a hard material such as carbide, for instance, a cemented tungsten carbide.

The interfacial surfaces 32 and 30, when taken together, are considered to be the interface 38 between superabrasive table 12 and substrate 10. The interface 38 may be generally nonplanar, i.e., having three-dimensional characteristics, and includes portions of superabrasive table 12 which extend into and are accommodated by substrate 10, and vice versa, since each comprises complementary features in relation to the other. In other words, any irregularity, or three-dimensional configuration, at the interface 38 may be looked upon as both a projection, or protrusion, of the substrate into the superabrasive table and the inverse, i.e., a projection, or protrusion, of the superabrasive table into the substrate. Therefore, if one defines the interfacial surface of one of the superabrasive table or substrate, the other interfacial surface of the substrate or superabrasive table, is simply the inverse, complementary shape thereof.

Substrate 10 includes a region 26 which is raised in relation to radially outer lip 25. Raised region 26 may, correspondingly, form an edge 13 of superabrasive table 12 that exhibits an increased thickness, or, alternatively, substrate 10 may not include a difference in elevation between the area of the raised region 26 and the area of the outer lip 25. The interfacial surface 30 of the substrate 10 is shown in FIG. 1A in a perspective view and includes outer lip 25 and raised region 26 as well as radially inner ring pattern 36 and radially outer ring pattern 40, both of which may be disposed within raised region 26 and generally about the central axis 28 of cutting element 20. As shown in FIG. 1A, inner ring pattern 36 comprises seven (7) inner raised sections 24 circumferentially separated by seven (7) radially extending inner grooves 27. Similarly, outer ring pattern 40 comprises seven (7) outer raised sections 22 circumferentially separated by seven (7) radially extending outer grooves 23. Inner raised sections 24 and outer raised sections 22 may be formed as protrusions that extend longitudinally from the raised region 26 of substrate 10. Further, inner raised sections 24 and outer raised sections 22 may be generally symmetric about central axis 28, as shown in FIGS. 1A and 1B.

As may be seen in reference to FIGS. 1A and 1B, the radially extending outer grooves 23 associated with the outer ring pattern 40 and the radially extending inner grooves 27 associated with the inner ring pattern 36 are not aligned with one another. Also, the inner raised sections 24 substantially circumferentially overlap with the radially extending outer grooves 23, while the radially extending inner grooves 27 substantially circumferentially overlap with the outer raised sections 22. Thus, the respective raised sections 22 and 24 and radially extending grooves 23 and 27 of radially adjacent ring patterns 40 and 36 are substantially circumferentially misaligned. Such a configuration may ameliorate, distribute, or reduce the residual stresses that develop within both the substrate 10 as well as the superabrasive table 12 in response to bonding and cooling during the manufacture of cutting element 20.

Figure 3A:
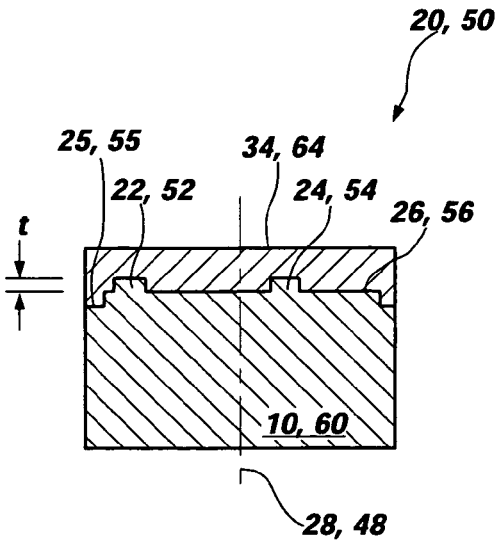
FIG. 3A is a side cross-sectional view of the cutting element shown in FIGS. 1A and 2A, taken across lines 3-3 and 8-8, respectively.
Figure 3B:
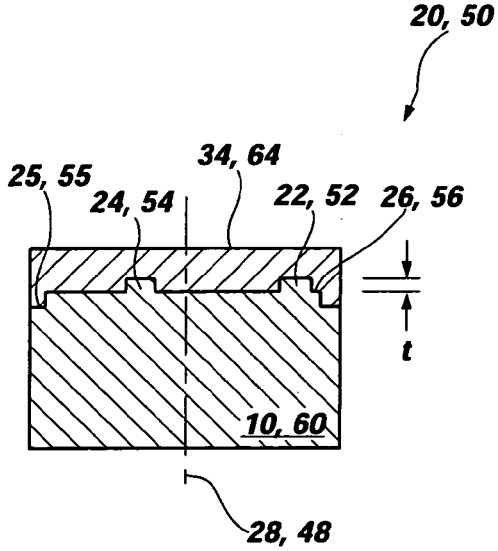
FIG. 3B is a side cross-sectional view of the cutting element shown in FIGS. 1A and 2A, taken across lines 4-4 and 6-6, respectively.

FIGS. 3A and 3B illustrate side cross-sectional views of cutting element 20, taken along reference line 3-3 and taken along reference line 4-4, shown in FIG. 1A, respectively. Reference line 3-3 is taken along a path extending through one of outer raised sections 22 and one of inner raised sections 24, wherein inner raised section 24 and outer raised section 22 are disposed on opposite sides of central axis 28. Similarly, reference line 4-4 is taken along a path extending through one of outer raised sections 22 and one of inner raised sections 24, wherein the inner raised section 24 shown and the outer raised section 22 shown are disposed on opposite sides of central axis 28. Inner raised section 24 and outer raised section 22 may exhibit a longitudinal thickness "t," referring to the distance from raised region 26 of substrate 10 which may be substantially the same. Alternatively, inner raised section 24 may exhibit a longitudinal thickness that is different from one or more outer raised sections 22, or may be different from one or more other inner raised sections 24. Analogously, outer raised section 22 may exhibit a longitudinal thickness that is different from one or more inner raised sections 24, or may be different from one or more other outer raised sections 22. Also, it should be noted that, for ease of illustration, the drawings generally show the raised sections 22 and 24 as having sharp corners. It is understood, however, that in practice, it is generally desirable to have rounded or beveled corners at the edges of intersecting surfaces or between different materials, particularly in areas where cracking may propagate.

It should be noted that the cross-sectional views shown in FIGS. 3A and 3B are only examples of particular cutting elements with particular geometries according to the present invention. Depending on the relative size of the inner sections, inner grooves, outer sections, and outer grooves, different cross-sectional views are encompassed by the present invention.

Of course, inner raised sections 24 and outer raised sections 22 may comprise other geometries and configurations as well. For instance, inner raised sections 24 and outer raised sections 22 may exhibit varying radial width (meaning a measurement radially across the area shown in FIG. 1B) or longitudinal thickness, as shown in FIGS. 3A and 3B. For instance, inner raised sections 24 and outer raised sections 22 may be dome-shaped, elliptical, or rectangular and may extend tangent to a circumferential path about central axis 28, or may extend along an arcuate path or straight path, without limitation. Also, the geometry of radially extending inner grooves 27 and radially extending outer grooves 23 may vary. Particularly, the width (meaning the distance between adjacent sections) may vary as well as the longitudinal depth of radially extending inner grooves 27, radially extending outer grooves 23, or both. Thus, radially extending inner grooves 27 and radially extending outer grooves 23 may extend into the substrate and may be shaped as desired, without limitation.

Figure 2B:
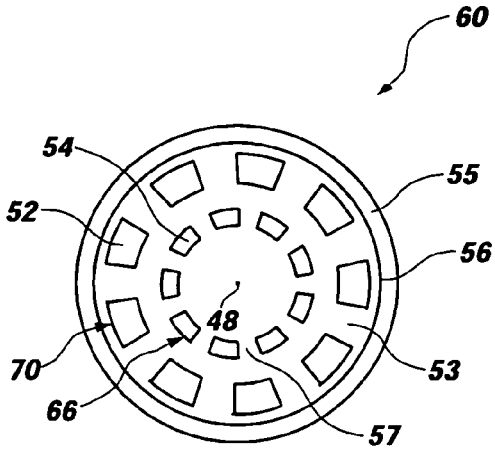
FIG. 2B is a top elevation of the exemplary cutting element shown in FIG. 2A.
Figure 2A:
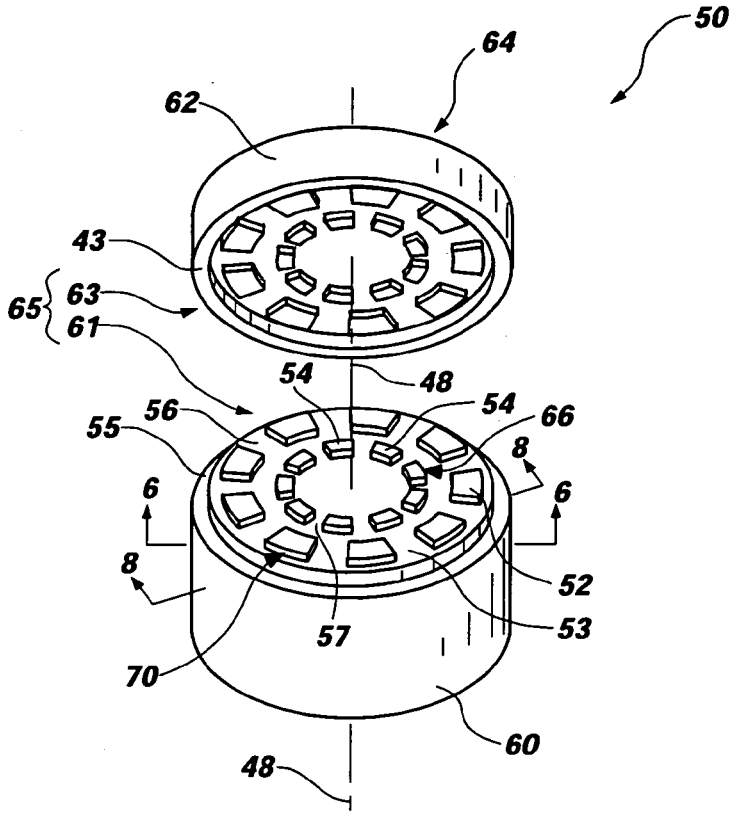
FIG. 2A is an exploded perspective view of another exemplary cutting element of the present invention.

In another embodiment of the present invention, FIGS. 2A and 2B show, in an exploded perspective view and a top elevational view, respectively, an exemplary cutting element 50 of the invention, generally disposed about a central axis 48 thereof. Cutting element 50 may comprise a superabrasive table 62 with cutting face 64 and an interfacial surface 63, which generally comprises complementary recesses (not labeled) in relation to the raised sections 52 and 54 described below, adjacent an interfacial surface 61 of substrate 60. The interfacial surfaces 63 and 61, when taken together, are considered to be the interface 65 between superabrasive table 62 and substrate 60. The interface 65 may be generally nonplanar, i.e., having three-dimensional characteristics, and may include portions of superabrasive table 62 which extend into and are accommodated by substrate 60, and vice versa, since each comprises complementary features in relation to the other. The superabrasive table 62 may be formed of diamond, a diamond composite, or other superabrasive material, as known in the art. Substrate 60 may be typically formed of a hard material such as carbide, for instance, such as a cemented tungsten carbide.

Substrate 60 may include a region 56 which is raised in relation to radially outer lip 55. Raised region 56 may, correspondingly, form an edge 43 of superabrasive table 62 that exhibits an increased thickness, or, alternatively, substrate 60 may not include a difference in elevation between the area of the raised region 56 and the area of the outer lip 55. The interfacial surface 61 of the substrate 60 is shown in FIG. 2A in a perspective view and includes outer lip 55 and raised region 56 as well as a radially inner ring pattern 66 and a radially outer ring pattern 70, both of which may be disposed within raised region 56 and generally about the central axis 48 of cutting element 50. As shown in FIG. 2A, inner ring pattern 66 may comprise nine (9) inner raised sections 54 circumferentially separated by nine (9) radially extending inner grooves 57. Similarly, outer ring pattern 70 may comprise nine (9) outer raised sections 52 circumferentially separated by nine (9) radially extending outer grooves 53. Outer raised sections 52 and inner raised sections 54 may be formed as protrusions that extend longitudinally from the raised region 56 of substrate 60. Further, outer raised sections 52 and inner raised sections 54 may be generally symmetrically spaced about central axis 48 as shown in FIGS. 2A and 2B or, alternatively, may be asymmetrically spaced about central axis 48.

The radially extending outer grooves 53 associated with the outer ring pattern 70 and the radially extending inner grooves 57 associated with the inner ring pattern 66 are circumferentially misaligned in relation to one another. Thus, the inner raised sections 54 substantially circumferentially overlap with the radially extending outer grooves 53, while the radially extending inner grooves 57 substantially circumferentially overlap, in a generally radial direction, with the outer raised sections 52. Thus, the respective raised sections 52 and 54 and radially extending grooves 53 and 57 of radially adjacent ring patterns 70 and 66 are substantially circumferentially misaligned. Such a configuration may ameliorate, distribute, or reduce the residual stresses that develop within both the substrate 60 as well as the superabrasive table 62 in response to bonding and cooling during the manufacture of cutting element 50. In addition, such a configuration may enhance the bonding strength between the substrate 60 and the superabrasive table 62.

FIGS. 3A and 3B illustrate side cross-sectional views of cutting element 50, taken along reference line 6-6 and taken along reference line 8-8, as shown in FIG. 2A, respectively. Reference line 6-6 is taken along a path extending through one of outer raised sections 52 and one of inner raised sections 54, wherein inner raised section 54 and outer raised section 52 are disposed on opposite sides of central axis 48. Similarly, reference line 8-8 is taken along a path extending through one of outer raised sections 52 and one of inner raised sections 54, wherein inner raised section 54 and outer raised section 52 are disposed on opposite sides of central axis 48. Inner raised section 54 and outer raised section 52 may extend from raised region 56 of substrate 60 to a longitudinal thickness "t." Alternatively, an inner raised section 54 may exhibit a longitudinal thickness that varies in relation to the longitudinal thickness of one or more outer raised sections 52, or one or more other inner raised sections 54. Further, an outer raised section 52 may exhibit a longitudinal thickness that varies in relation to the longitudinal thickness of one or more of other outer raised sections 52, or in relation to one or more of inner raised sections 54.

The substrate 60 and/or superabrasive table 62, aside from the at least two circumferentially misaligned ring patterns, may be of any cross-sectional configuration, or shape, including circular, polygonal, and irregular. Accordingly, as known in the art, the superabrasive table 62 may include one or more chamfers or buttress geometries formed on the outer radial region thereof. In addition, the superabrasive table 62 may have a cutting face 64 which is flat, rounded, or of any other suitable configuration.

As can now be appreciated, a cutting element interface embodying the present invention provides enhanced resistance to fracture, spalling, and delamination of the superabrasive table, or compact.

Therefore, the present invention comprises at least one inner ring pattern disposed within another ring pattern wherein the outer raised sections are aligned with inner grooves and inner raised sections are aligned with outer grooves. Further, preferably, the number of inner sections, outer sections, inner grooves, and outer grooves may be the same and may be an odd number. An odd number of raised sections comprising each ring pattern may be advantageous, particularly for reducing symmetry. Symmetrical stress patterns generally may develop within a substantially cylindrical superabrasive table and substantially cylindrical substrate that are bonded to one another. Even if the superabrasive table and substrate interfacial surfaces are nonplanar, nonplanar geometries that are symmetric about the longitudinal axis as well as another axis or plane, for instance, a cross-section through the cutting element, perpendicular to the cutting face thereof which divides the cutting element in half, may retain or form stress fields that are a product of, at least partially, such symmetry. A configuration including one or more smaller ring patterns disposed within one or more larger ring patterns wherein radially adjacent ring patterns are circumferentially misaligned may have a propensity to separate or beneficially distribute residual stresses which develop, at least partially, in response to symmetry, particularly if the number of raised sections in each ring pattern is odd. Put another way, such a configuration may reduce symmetry of the residual stress field, which may reduce the maximum and minimum stresses within either of the substrate and superabrasive table. Such a stress state may be preferable within a cutting element to resist fracturing, defoliation, or delamination during use thereof. It should be understood, however, that the present invention is not limited to ring patterns with an odd number of sections, but rather, only that such a configuration may be preferable. Another preferable ring pattern configuration that may tend to separate or distribute the symmetry of stress fields within the cutting element may be radially adjacent, circumferentially misaligned ring patterns wherein one ring pattern contains an even number of raised sections and one ring pattern contains an odd number of sections. Conversely, there may be configurations that exhibit sufficient separation or distribution of residual stress fields despite including ring patterns including an even number of sections. Therefore, in general, any circumferentially misaligned ring pattern of the present invention may comprise an even or odd number of sections, without limitation.

Figure 4A:
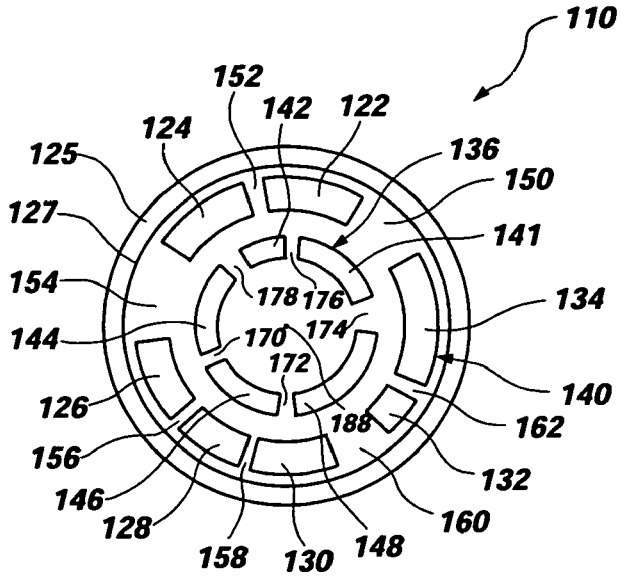
FIG. 4A is a top elevational view of a further exemplary cutting element of the invention.

Illustratively, an equal number of raised sections in each ring pattern, equal sizing of each raised section, or equal spacing of each raised section in relation to other raised sections within each ring pattern is not required to accomplish substantially circumferential misalignment according to the present invention. As shown in FIG. 4A, which shows a top elevational view of a substrate 110 of the present invention, substrate 110 may include a radially outer lip 125 and a raised surface 127, as described hereinabove in relation to similar features of substrates 10 and 50. In addition, an outer ring pattern 140 of substrate 110 may comprise differently sized outer raised sections 122, 124, 126, 128, 130, 132, and 134 disposed about central axis 188, which are circumferentially separated by differently sized radially extending outer grooves 150, 152, 154, 156, 158, 160, and 162, while inner ring pattern 136 may comprise differently sized inner raised sections 141, 142, 144, 146, and 148, also disposed about central axis 188, which are circumferentially separated by differently sized radially extending inner grooves 170, 172, 174, 176, and 178. As may be seen in reference to FIG. 4A, inner ring pattern 136 may be substantially circumferentially misaligned in relation to outer ring pattern 140, since inner raised sections 141, 142, 144, 146, and 148 substantially circumferentially overlap radially extending outer grooves 150, 152, 154, 156, 158, 160, and 162, while the outer raised sections 122, 124, 126, 128, 130, 132, and 134 substantially circumferentially overlap radially extending inner grooves 170, 172, 174, 176, and 178.

Figure 4B:
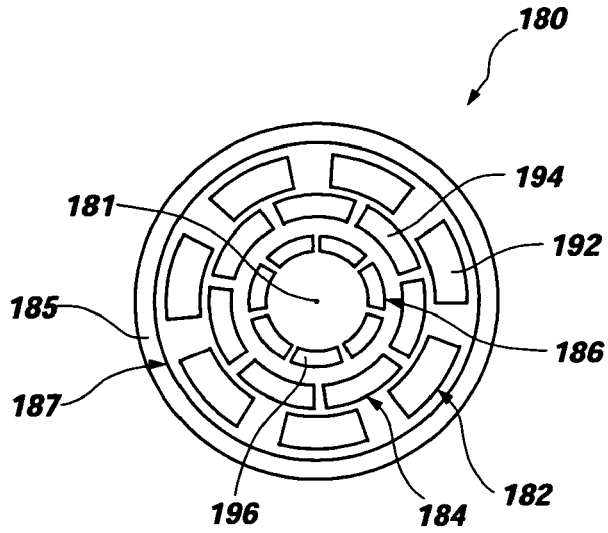
FIG. 4B is a top elevational view of another exemplary cutting element of the invention.

It should further be understood that a cutting element according to the present invention may include more than two ring patterns. For instance, a cutting element of the present invention may include a substrate that exhibits three ring patterns, wherein at least two radially adjacent ring patterns are substantially circumferentially misaligned. FIG. 4B shows a top elevational view of a substrate 180 of the present invention including outer radial lip 185, raised surface 187, and ring patterns 182, 184, and 186. Ring pattern 182 comprises raised sections 192, which may be substantially identical and positioned symmetrically about central axis 181. Put another way, each of raised sections 192 may be substantially identical in shape and size. Optionally, each of raised sections 192 may be positioned symmetrically about central axis 181. Also, ring pattern 184 comprises raised sections 194, which may be substantially identical and positioned symmetrically about central axis 181. Moreover, ring pattern 186 comprises raised sections 196, which may be substantially identical and positioned symmetrically about central axis 181. Also, as another variation, it should be understood that the centers of each of the ring patterns 182, 184, 186 may not be identical. In other words, the ring patterns of the present invention need not be concentric or even substantially concentric. Further, the ring patterns of the present invention may be elliptical or substantially ring-like, meaning arranged in a generally closed form (e.g., rectangular, triangular, polygonal) in their configuration rather than being substantially circular.

Figure 4C:
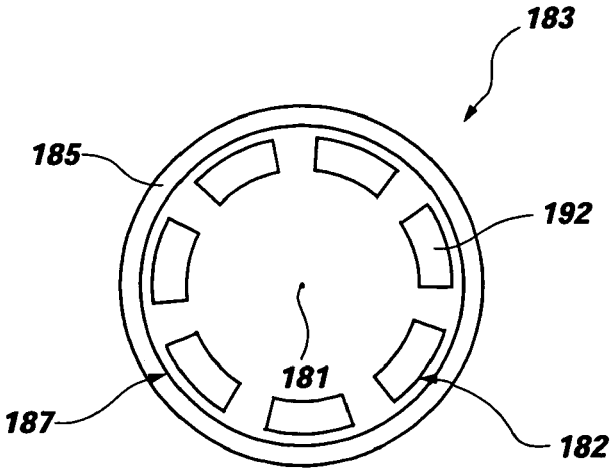
FIG. 4C is a top elevational view of yet another exemplary cutting element of the invention.

As yet another embodiment, a cutting element according to the present invention may include at least one ring pattern having an odd number of sections. For instance, FIG. 4C shows a top elevational view of a substrate 183 including one ring pattern comprising 7 (seven) sections 192. More particularly, FIG. 4C shows a top elevational view of a substrate 183 of the present invention including outer radial lip 185, raised surface 187, and ring pattern 182. Ring pattern 182 comprises raised sections 192, which may be substantially identical and positioned symmetrically about central axis 181. Such a configuration may reduce symmetry and distribute symmetrical stress fields in the substrate 183, the superabrasive table (not shown) associated therewith, or both.

Figure 5A:
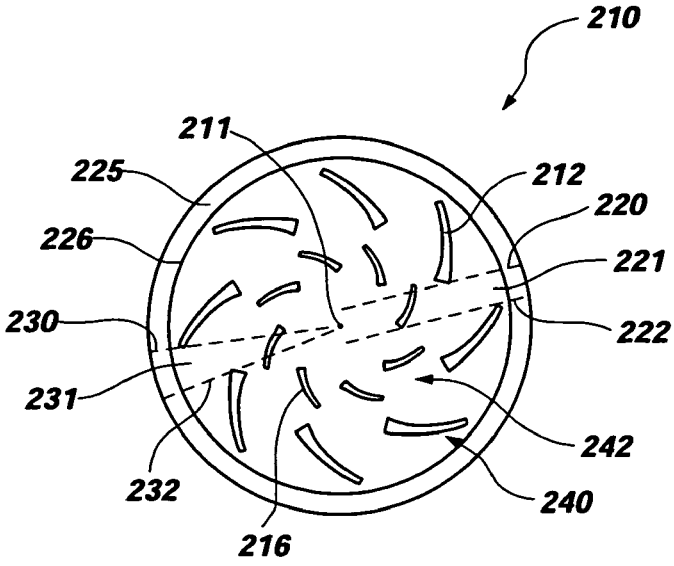
FIG. 5A is a top elevational view of yet another exemplary cutting element of the invention.
Figure 5B:
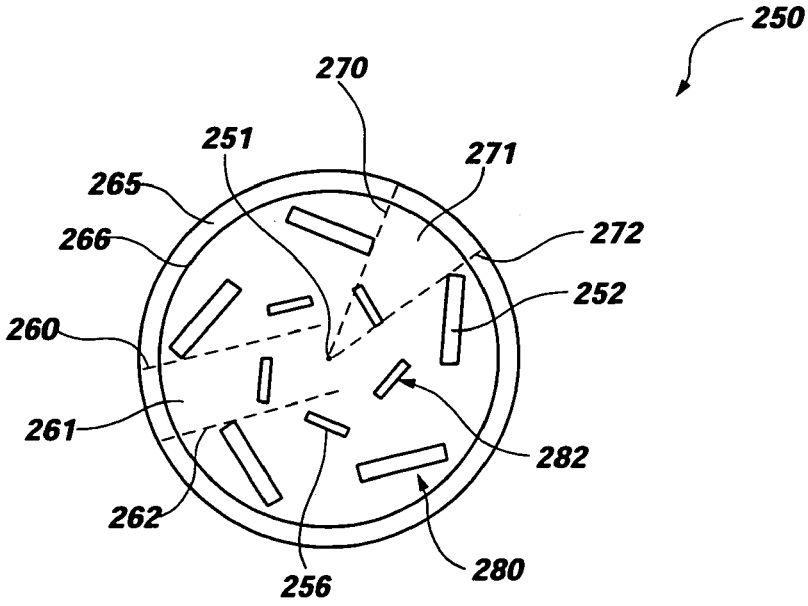
FIG. 5B is a top elevational view of yet a further exemplary cutting element of the invention.

To further illustrate substantially circumferentially misaligned configurations, FIGS. 5A and 5B illustrate substrates 210 and 250 of the present invention in top elevational views, respectively. Substrate 210 includes radially outer lip 225 and a raised surface 226. Further, substrate 210 includes outer ring pattern 240 comprising outer raised sections 212 and inner ring pattern 242 comprising inner raised sections 216 extending from raised surface 226. Reference line 220 and reference line 222 may be used to define a generally radially extending groove 221 therebetween. Radially extending groove 221 may be defined by reference lines 220 and 222 that are parallel to a line (not shown) that bisects the angle formed between the circumferentially nearest points of each of circumferentially adjacent outer raised sections 212, in relation to a line extending radially from the central axis 211 to the circumferentially nearest points. Such a configuration may define radially extending groove 221 that extends between adjacent outer raised sections 212 and exhibits a generally rectangular shape. Alternatively, radially extending groove 231 may be defined by reference line 230 and reference line 232, wherein reference lines 230 and 232 extend from the longitudinal axis of substrate 210 radially outwardly through both of the endpoints of the arc forming the angle between circumferentially nearest points of each of circumferentially adjacent outer raised sections 212, in relation to the central axis 211 of the substrate 210. Thus, radially extending groove 231 may exhibit a pie-shaped wedge or circular section shape. As may be seen, inner raised sections 216 substantially circumferentially overlap with either radially extending groove 231 or radially extending groove 221. The present invention contemplates that radially adjacent ring patterns may be substantially circumferentially misaligned when raised sections thereof, respectively, substantially circumferentially overlap radially extending grooves that are defined in the same fashion as either of the radially extending grooves 221 or 231.

Similarly, turning to FIG. 5B, substrate 250 includes radially outer lip 265 and a raised portion 266. Further, substrate 250 may include outer ring pattern 280 comprising outer raised sections 252 extending from raised portion 266 and inner ring pattern 282 comprising inner raised sections 256 extending from raised portion 266. Reference line 260 and reference line 262 may define a generally radially extending groove 261 therebetween. Radially extending groove 261 may be defined by reference lines 260 and 262 that are parallel to a line (not shown) that perpendicularly bisects an arc forming the smallest angle between circumferentially adjacent outer raised sections 252, in relation to the central axis 251 of the substrate 250. Such a configuration may define radially extending groove 261 that extends between adjacent outer raised sections 252 and exhibits a generally rectangular shape. Alternatively, radially extending groove 271 may be defined by reference line 270 and reference line 272, wherein reference lines 270 and 272 extend from the central axis 251 of substrate 250 radially outwardly through both of the endpoints of the arc forming the smallest angle between circumferentially adjacent outer raised sections 252, in relation to the longitudinal axis of the substrate 250. Thus, radially extending groove 271 exhibits a pie-shaped wedge or circular section shape. As may be seen, inner raised sections 256 substantially circumferentially overlap either radially extending groove 271 or radially extending groove 261. The present invention contemplates that either definition of radially extending grooves 261 or 271 may be utilized or employed.

Of course, each of the substrates 110, 210 and 250, as described above, may be preferably employed to form a cutting element including a superabrasive table with an interfacial surface having mutually complementary but reverse features. Such a cutting element, in effect, may provide the previously described residual stress mitigation, distribution, or separation benefits of the at least one ring pattern disposed within at least another ring pattern wherein radially adjacent ring patterns are substantially circumferentially misaligned, as exhibited by the cutting elements illustrated in the drawings and described herein.

Figure 6A:
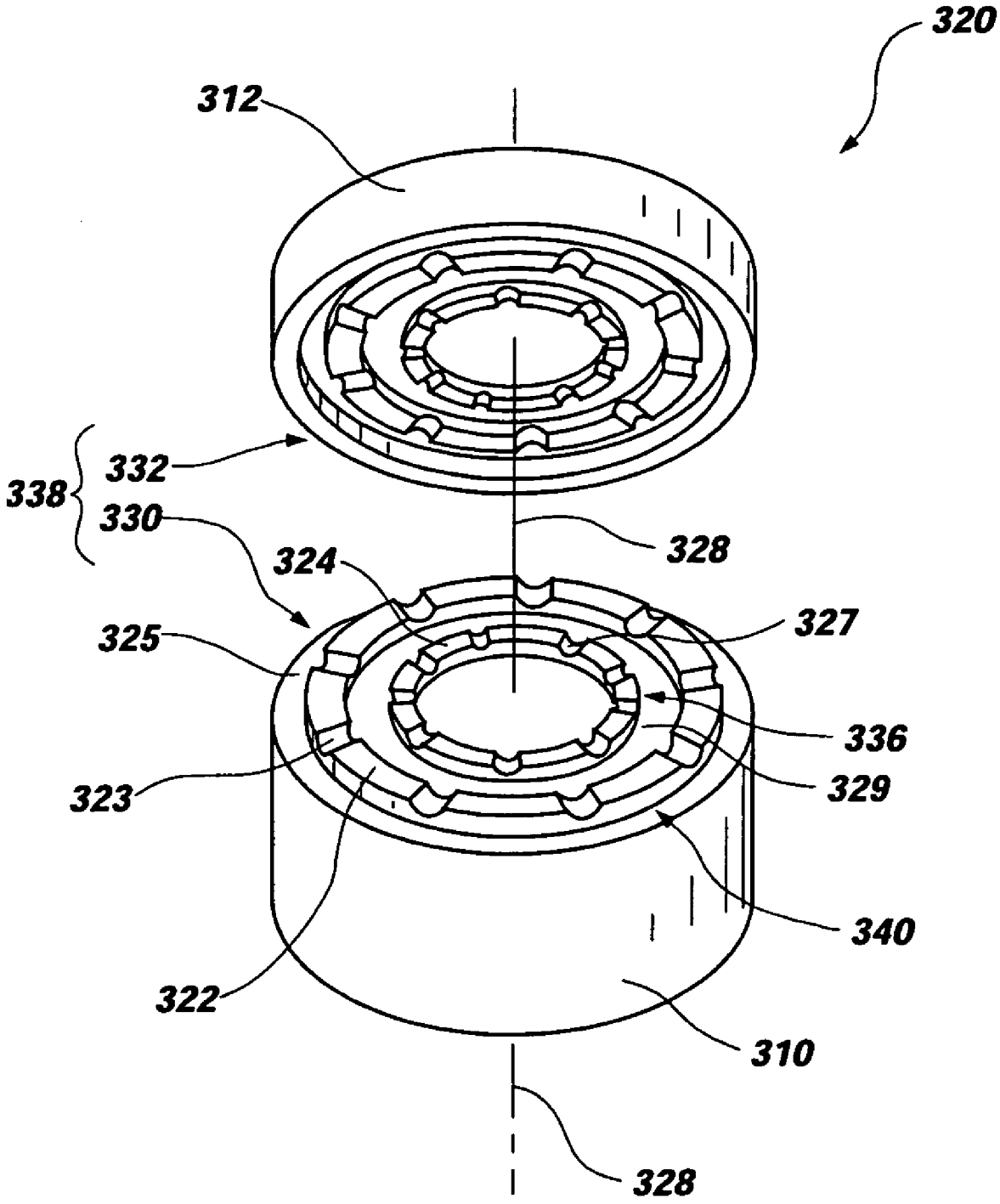
FIG. 6A is an exploded perspective view of an additional exemplary cutting element of the invention.

In yet another embodiment of the present invention, FIG. 6A shows a cutting element 320 in an exploded perspective view, the cutting element 320 including superabrasive table 312, wherein superabrasive table interfacial surface 332 generally includes complementary recesses (not labeled) in relation to raised sections 322 and 324 as described below, and substrate 310. As shown in FIG. 6A, interfacial surface 330 of substrate 310 includes inner ring pattern 336 disposed about central axis 328, which comprises inner raised sections (or ridges) 324 circumferentially separated by radially extending inner grooves 327. The interfacial surfaces 332 and 330, when taken together, are considered to be the interface 338 between superabrasive table 312 and substrate 310. Similarly, interfacial surface 330 of substrate 310 includes outer ring pattern 340 disposed about central axis 328 which comprises outer raised sections (or ridges) 322 circumferentially separated by radially extending outer grooves 323. Outer ring pattern 340 extends longitudinally upwardly from substantially planar surface 325 and inner ring pattern 336 extends longitudinally upwardly from substantially planar surface 329, wherein substantially planar surface 325 and substantially planar surface 329 may be coplanar. However, radially extending inner grooves 327 and radially extending outer grooves 323 may not extend longitudinally to substantially planar surface 329 or substantially planar surface 325, respectively. Therefore, as shown in FIG. 6A, the outer ring pattern 340 and the inner ring pattern 336 may each comprise a continuous raised ring portion as well as the circumferential separated raised sections 322 or 324 thereof. Furthermore, radially extending outer grooves 323 associated with the outer ring pattern 340 and the radially extending inner grooves 327 associated with the inner ring pattern 336 may not be aligned with one another. Also, the inner raised sections 324 may substantially circumferentially overlap with the radially extending outer grooves 323, while the radially extending inner grooves 327 may substantially circumferentially overlap with the outer raised sections 322. Thus, the respective raised sections 322 and 324 and radially extending grooves 323 and 327 of radially adjacent ring patterns 340 and 336 may be substantially circumferentially misaligned.

Figure 6B:
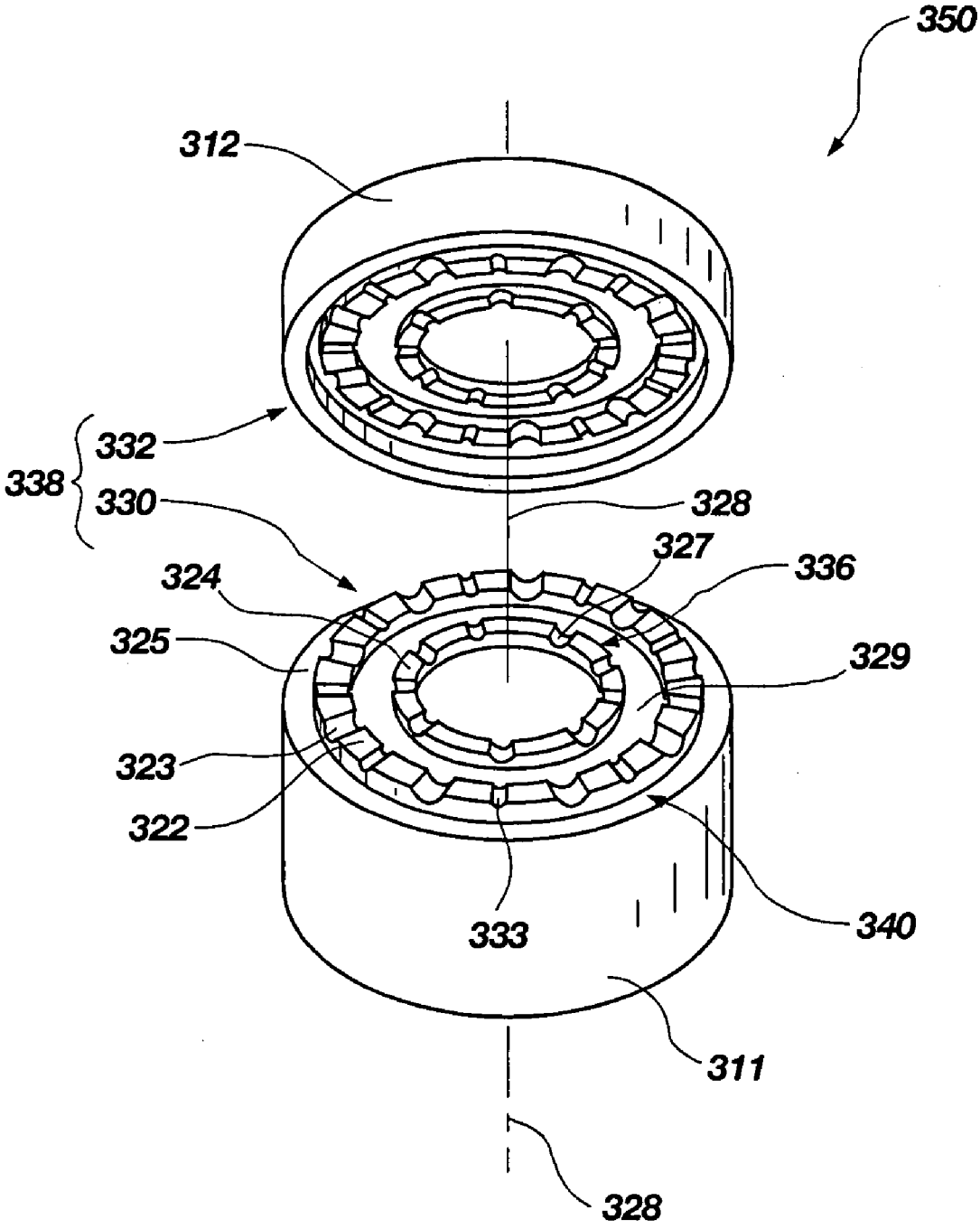
FIG. 6B is an exploded perspective view of a further exemplary cutting element of the invention.
Figure 6C:
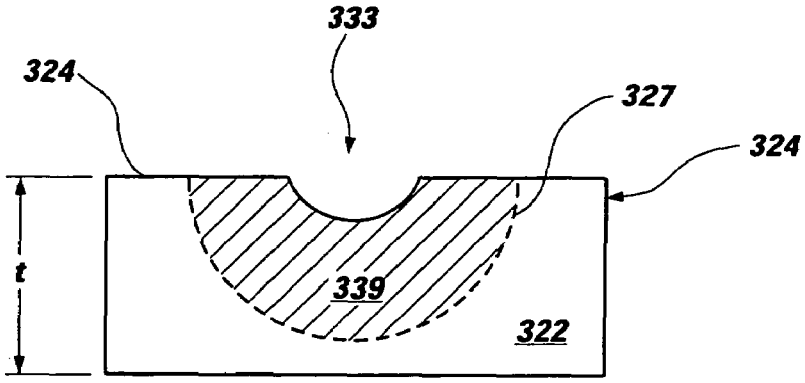
FIG. 6C is a side schematic view of the circumferential overlap between a raised section, a radially extending groove, and a secondary recess as shown in FIG. 6B.

In yet a further embodiment of the present invention, as shown in FIG. 6B which illustrates an exploded perspective view of cutting element 350, which may be configured as described above with respect to cutting element 320 and may also include secondary recesses 333. Secondary recesses 333 may have the desired effect of adjusting the degree of distribution of residual stress within the substrate, the superabrasive table, or both. However, it should be recognized that secondary recesses, if configured appropriately, may partially circumferentially overlap with the radially extending inner grooves 327. More particularly, FIG. 6C illustrates the position and size of a radially extending inner groove 327 in relation to one of secondary recesses 333 in a schematic view as if looking radially inwardly from the side of substrate 311. Particularly, one of radially extending inner grooves 327 is shown as formed between raised sections 324, and one of secondary recesses 333 is shown as formed in raised section 322. Overlap region 339 shows the circumferential overlap between the radially extending inner groove 327 and the outer raised section 322. Thus, the size of secondary recess 333 may reduce the size of overlap region 339, which would include the area of secondary recess 333 if secondary recess 333 were not formed. However, as the overlap region 339 is substantial in relation to the overall size of radially extending inner groove 327, the outer raised section 322 substantially circumferentially overlaps with the inner groove 327. Further, the outer grooves 323 may substantially circumferentially overlap with the inner raised sections 324. Thus, such a configuration may exhibit substantially circumferential misalignment. It may be appreciated that the longitudinal thickness "t" of the raised sections 322 and 324 may be adjusted to affect the circumferential overlap between outer raised section 322 and inner groove 327, as well as the size and position of secondary recess 333 and the size and position of radially extending inner groove 327.

While the above embodiments are described in terms of sections that protrude or extend from the substrate, similar advantages may be achieved by forming the interfacial surfaces as described above as extending from the superabrasive table, or, put another way, by forming the inverse of the interfacial surfaces, described in the embodiments above, into the substrate. Since diamond powder is normally applied to the substrate prior to the ultra high pressure, ultra high temperature process of fabrication of a PDC cutting element, geometric features may be formed into or onto the substrate in order to cause the superabrasive table to be formed accordingly. Since the residual stresses that develop within the superabrasive table and carbide are, to some extent, related to one another, it would be apparent that such a configuration may ameliorate, distribute, or reduce the residual stresses that develop within both the substrate as well as the superabrasive table in response to bonding and cooling during the manufacture of a cutting element by separating or distributing residual stress fields. While such a configuration may not produce identical stress fields as if the pattern were formed as extending from the substrate rather than into the substrate, since the mechanical behavior of diamond (or any superabrasive material generally) and the substrate may be largely different from one another, the overall effect, however, may be similar to the desired residual stress states described hereinabove.

Figure 7:
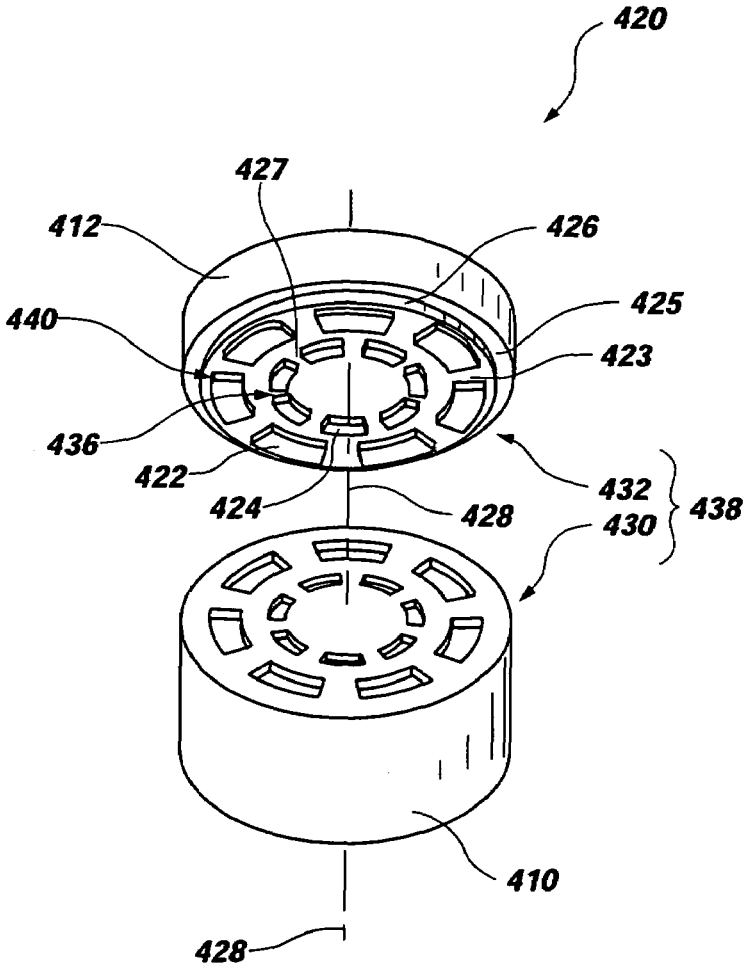
FIG. 7 is an exploded perspective view of yet a further exemplary cutting element of the invention.

Therefore, for completeness, one example of an embodiment of the present invention wherein the superabrasive table exhibits at least two ring patterns that are circumferentially misaligned is shown in FIG. 7. Specifically, FIG. 7 shows a cutting element 420 in an exploded perspective view, the cutting element 420 including superabrasive table 412 and substrate 410, wherein the interfacial surface 430 of substrate generally includes recesses (not labeled) that are complementarily shaped in relation to the raised sections 422 and 424 of interfacial surface 432, as described below. The interfacial surfaces 432 and 430, when taken together, are considered to be the interface 438 between superabrasive table 412 and substrate 410.

As shown in FIG. 7, superabrasive table 412 interfacial surface 432 comprises an inner ring pattern 436 disposed about central axis 428 and having inner raised sections 424 circumferentially separated by radially extending inner grooves 427. Superabrasive table 412 also comprises an outer ring pattern 440 disposed about central axis 428 and includes outer raised sections 422 circumferentially separated by radially extending outer grooves 423. Superabrasive table 412 may also include a raised surface 426 in relation to outer lip 425. Outer ring pattern 440 extends longitudinally upwardly from raised surface 426 and inner ring pattern 436 extends longitudinally upwardly from raised surface 426. Furthermore, radially extending outer grooves 423 associated with the outer ring pattern 440 and the radially extending inner grooves 427 associated with the inner ring pattern 436 may not be aligned with one another. Moreover, inner raised sections 424 substantially circumferentially overlap with the radially extending outer grooves 423, while the radially extending inner grooves 427 substantially circumferentially overlap with the outer raised sections 422. Thus, the respective raised sections 422 and 424 and radially extending grooves 423 and 427 of radially adjacent ring patterns 440 and 436 may be substantially circumferentially misaligned. Of course, any of the above-described embodiments of ring patterns according to the present invention may be employed as extending from a superabrasive table, without limitation.

Figure 8A:
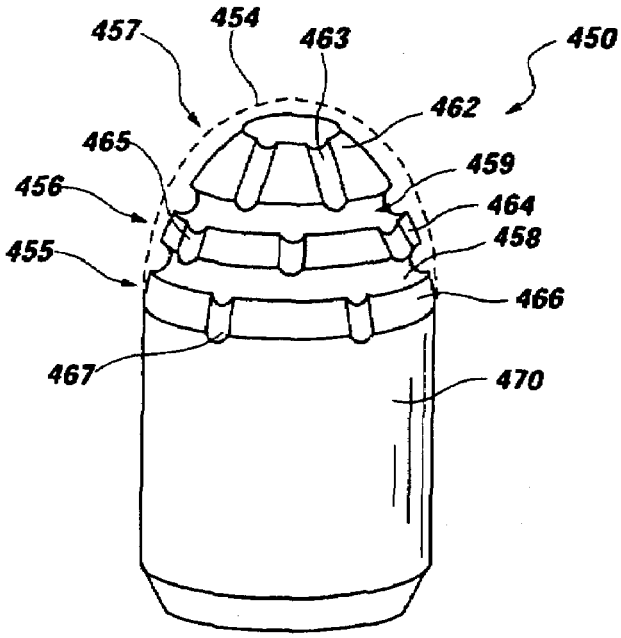
FIG. 8A is a side perspective view of an additional exemplary cutting element of the invention.
Figure 8B:
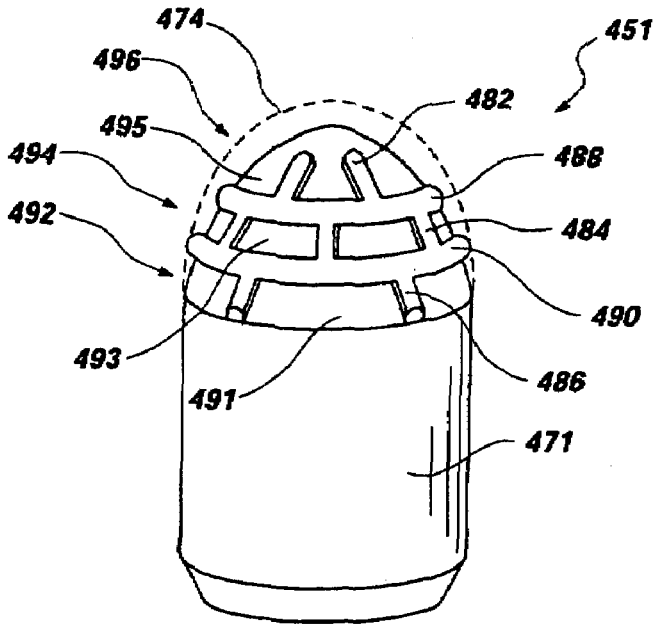
FIG. 8B is a side perspective view of another exemplary cutting element of the invention.

As yet a further aspect of the present invention, although interfacial surfaces including ring patterns according to the present invention are shown hereinabove as being formed upon or within a generally planar, or flat, substrate surface or end, the present invention is not so limited. For instance, the configuration of the substrate interface surface may be dome-shaped, hemispherically shaped, or otherwise arcuate in shape such as the interfacial ends of substrates 470 and 471 of cutting elements 450 and 451, respectively illustrated in FIGS. 8A and 8B, yet maintain the preferred interfacial pattern as described above or variations thereof. Substrates 470 and 471 may have an elongated body that extends from the interfacial ends thereof, as shown in FIGS. 8A and 8B. Similarly, generally dome-shaped superabrasive tables 454 and 474 may be disposed over and each have a complementary superabrasive table interface surface to accommodate the interface surface of the substrates 450 and 451, respectively. A cutting element having such a dome-shaped or hemispherically shaped substrate and superabrasive table and an elongated body may be particularly suitable for installation and use on a rotary drill bit, such as, for example, a roller cone style drill bit in which a plurality of cutting elements are installed, as by press fitting or brazing, on one or more roller cones so as to be moveable with respect to the drill bit while engaging the formation.

More specifically, FIG. 8A shows a substrate 470 including ring patterns 455, 456, and 457, arranged radially and longitudinally adjacent one another, along the upper domed surface of substrate 470, wherein circumferentially extending groove 458 separates ring patterns 455 and 456, while circumferentially extending groove 459 separates ring patterns 457 and 456. Ring pattern 455 includes raised sections 466 spaced about the circumference of substrate 470, wherein raised sections 466 are separated by grooves 467. Similarly, ring pattern 456 includes raised sections 464 spaced about the circumference of substrate 470, wherein raised sections 464 are separated by grooves 465. Further, ring pattern 457 includes raised sections 462 spaced about the circumference of substrate 470, wherein raised sections 462 are separated by grooves 463. Radially adjacent ring patterns 455 and 456 are substantially circumferentially misaligned, since raised sections 464 substantially circumferentially overlap with grooves 467, while grooves 465 substantially circumferentially overlap with the raised sections 466. In addition, radially adjacent ring patterns 456 and 457, as shown in FIG. 8A, are substantially circumferentially misaligned, since raised sections 464 substantially circumferentially overlap with grooves 463, while grooves 465 substantially circumferentially overlap with the raised sections 462.

As noted above, similar advantages may be achieved by forming the interfacial surfaces as described above on the superabrasive table, or, put another way, by forming the inverse of the interfacial surfaces, depicted in the embodiments above, into the substrate. Accordingly, FIG. 8B shows the inverse of the interfacial surface depicted in FIG. 8A, formed onto the upper end of substrate 471. Particularly, substrate 471 including ring patterns 492, 494, and 496, arranged radially and longitudinally adjacent one another, along the upper domed surface of substrate 471, wherein circumferentially extending protrusion 490 separates ring patterns 492 and 494, while circumferentially extending protrusion 488 separates ring patterns 494 and 496. Ring pattern 492 includes depressions 491 spaced about the circumference of substrate 471, separated by ribs 486. Similarly, ring pattern 494 includes depressions 493 spaced about the circumference of substrate 471, separated by ribs 484. Further, ring pattern 496 includes depressions 495 spaced about the circumference of substrate 471, separated by ribs 482. As may be appreciated, the ribs 486 of ring pattern 492 are not aligned with the ribs 484 of ring pattern 494. Likewise, the ribs 484 of ring pattern 494 are not aligned with the ribs 482 of ring pattern 496. It may be appreciated that such a configuration, when formed with a superabrasive table 474, would produce an inverse interfacial surface upon the superabrasive table 474 exhibiting radially adjacent ring patterns that are substantially circumferentially misaligned.

Figure 9:
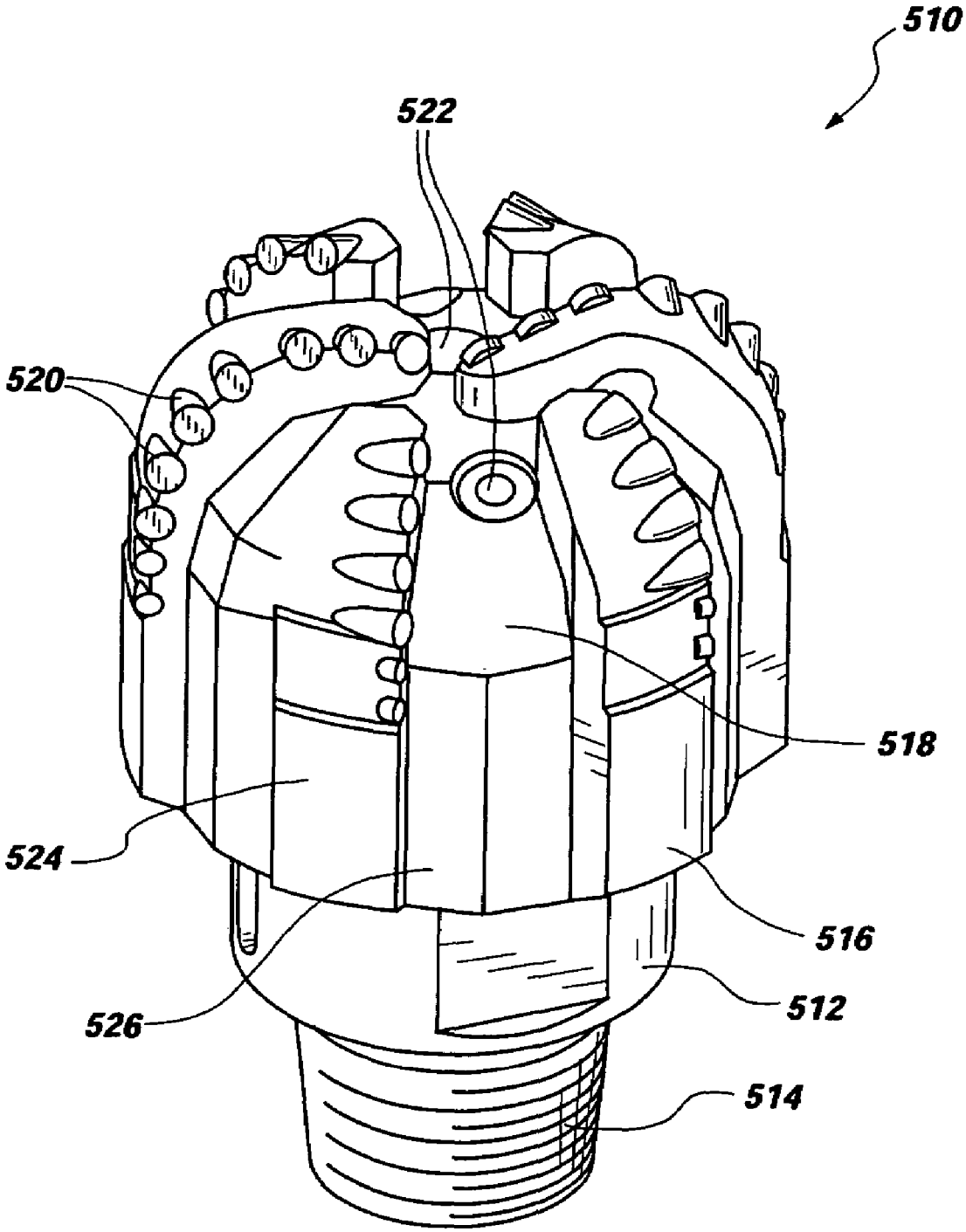
FIG. 9 shows a perspective view of a drill bit incorporating at least one cutting element of the present invention.

In addition, the present invention includes a tool for drilling a borehole into a subterranean formation, such as, for instance, a rotary drill bit. In FIG. 9 is shown an exemplary, but not limiting, rotary drill bit 510 which incorporates at least one cutting element 520 of the invention. The illustrated drill bit 510 is known in the art as a fixed cutting element or drag bit used for drilling earth formations, and may be particularly suitable for drilling oil, gas, and geothermal wells. Cutting elements 520 of this invention may be advantageously used in any of a wide variety of drill bit 510 configurations which use cutting elements. Drill bit 510 includes a bit shank 512 having a tapered pin end 514 for threaded connection to a drill string, not shown, and also includes a body 516 having a face 518 on which cutting elements 520 may be secured. Bit 510 typically includes a series of nozzles 522 for directing drilling mud to the face 518 of body 516 for removal of formation cuttings to the bit gage 524 and to facilitate passage of cuttings through junk slots 526, past the bit shank 512 and up the annulus between the drill string and the well bore toward the surface or to the surface to be discharged. It should be understood that cutting elements of the present invention, as described hereinabove, can also be installed in roller-cone style drill bits either as inserts installed on a rotatable roller-cone so as to movingly engage and cut the formation, or on the body thereof.

Although specific embodiments have been shown by way of example in the drawings and have been described in detail herein, the invention may be susceptible to various modifications, combinations, and alternative forms. Therefore, it should be understood that the invention is not intended to be limited to the particular forms disclosed. Rather, the invention includes all modifications, equivalents, combinations, and alternatives falling within the spirit and scope of the invention as defined by the following appended claims.

What is claimed is:

1. A cutting element for use on a tool for forming a borehole in a subterranean formation, comprising:

a substrate having a layer of superabrasive material disposed on an end surface thereof, wherein an interface between the substrate and the layer of superabrasive material comprises:

a first ring pattern including a plurality of raised sections circumferentially separated by respective grooves; and at least a second ring pattern, wherein each of the at least a second ring pattern includes a plurality of raised sections circumferentially separated by respective grooves;

wherein at least one of the first ring pattern and the at least a second ring pattern includes an odd number of raised sections; and wherein each raised section of the first ring pattern substantially circumferentially overlaps a groove of the at least a second ring pattern and at least partially circumferentially overlaps at least one raised section of the at least a second ring pattern adjacent the groove of the at least a second ring pattern overlapped thereby.

2. The cutting element of claim 1, wherein the plurality of raised sections of both the first ring pattern and the at least a second ring pattern extend from the end surface of the substrate into the layer of superabrasive material.

3. The cutting element of claim 1, wherein the plurality of raised sections of both the first ring pattern and the at least a second ring pattern extend from a surface of the layer of superabrasive material into the substrate.

4. The cutting element of claim 1, wherein:

each of the plurality of raised sections of the first ring pattern is substantially identical; and each of the plurality of raised sections of the at least a second ring pattern is substantially identical.

5. The cutting element of claim 1, wherein the plurality of raised sections of the first ring pattern are substantially equally circumferentially spaced in relation to one another.

6. The cutting element of claim 1, wherein each raised section of the first ring pattern at least partially circumferentially overlaps each raised section of the at least a second ring pattern adjacent the groove of the at least a second ring pattern overlapped thereby.

7. The cutting element of claim 6, wherein the first ring pattern and the at least a second ring pattern comprise the same number of raised sections.

8. The cutting element of claim 6, wherein the first ring pattern comprises an odd number of raised sections.

9. The cutting element of claim 8, wherein the at least a second ring pattern comprises an odd number of raised sections.

10. The cutting element of claim 9, wherein the first ring pattern and the at least a second ring pattern comprise the same number of raised sections.

11. The cutting element of claim 10, wherein:

each of the plurality of raised sections of the first ring pattern is substantially identical; and each of the plurality of raised sections of the at least a second ring pattern is substantially identical.

12. The cutting element of claim 1, further comprising at least one secondary recess formed in an upper portion of a raised section of at least one of the first ring pattern and the at least a second ring pattern.

13. The cutting element of claim 1, wherein the substrate has a longitudinal axis, and wherein each groove of the at least a second ring pattern is defined as the area of the interface between a first path extending substantially radially outward from the longitudinal axis along the interface through a point on a first raised section of the at least a second ring pattern and a second path extending substantially radially outward from the longitudinal axis along the interface through a point on a second raised section of the at least a second ring pattern, the first raised section and the second raised section comprising circumferentially adjacent sections of the at least a second ring pattern, the point on the first raised section and the point on the second raised section comprising circumferentially nearest points of the first raised section and the second raised section.

14. The cutting element of claim 1, wherein the substrate is substantially cylindrical and the first ring pattern and the at least a second ring pattern extend from a substantially planar end surface of the substrate.

15. The cutting element of claim 1, wherein the substrate comprises an elongated body with a domed end surface and the first ring pattern and the at least a second ring pattern extend from the domed end surface.

16. The cutting element of claim 1, wherein each of the first ring pattern and the at least a second ring pattern are arranged in one of a substantially circular, a substantially elliptical, and a ring-like fashion.

17. The cutting element of claim 1, wherein the first ring pattern and the at least a second ring pattern are concentric.

18. The cutting element of claim 1, wherein the superabrasive material comprises polycrystalline diamond.

19. A rotary drill bit for drilling a subterranean formation, comprising:

a bit body having a face; and at least one cutting element mounted on the face of the bit body, the at least one cutting element comprising a substrate having a layer of superabrasive material disposed on an end surface thereof;

wherein an interface between the substrate and the layer of superabrasive material comprises:

a first ring pattern including a plurality of raised sections circumferentially separated by grooves; and at least a second ring pattern, wherein each of the at least a second ring pattern includes a plurality of raised sections circumferentially separated by grooves;

wherein at least one of the first ring pattern and the at least a second ring pattern includes an odd number of raised sections; and wherein each raised section of the first ring pattern substantially circumferentially overlaps a groove of the at least a second ring pattern and at least partially circumferentially overlaps at least one raised section of the at least a second ring pattern adjacent the groove of the at least a second ring pattern overlapped thereby.

20. The rotary drill bit of claim 19, wherein the plurality of raised sections of both the first ring pattern and the at least a second ring pattern extend from the end surface of the substrate into the layer of superabrasive material.

21. The rotary drill bit of claim 19, wherein the plurality of raised sections of both the first ring pattern and the at least a second ring pattern extend from a surface of the layer of superabrasive material into the substrate.

22. The rotary drill bit of claim 19, wherein:

each of the plurality of raised sections of the first ring pattern is substantially identical; and each of the plurality of raised sections of the at least a second ring pattern is substantially identical.

23. The rotary drill bit of claim 19, wherein the plurality of raised sections of the first ring pattern are substantially equally circumferentially spaced in relation to one another.

24. The rotary drill bit of claim 19, wherein each raised section of the first ring pattern at least partially circumferentially overlaps each raised section of the at least a second ring pattern adjacent the groove of the at least a second ring pattern overlapped thereby.

25. The rotary drill bit of claim 24, wherein the first ring pattern and the at least a second ring pattern comprise the same number of raised sections.

26. The rotary drill bit of claim 24, wherein the first ring pattern comprises an odd number of raised sections.

27. The rotary drill bit of claim 26, wherein the at least a second ring pattern comprises an odd number of raised sections.

28. The rotary drill bit of claim 27, wherein the first ring pattern and the at least a second ring pattern comprise the same number of raised sections.

29. The rotary drill bit of claim 28, wherein:

each of the plurality of raised sections of the first ring pattern is substantially identical; and each of the plurality of raised sections of the at least a second ring pattern is substantially identical.

30. The rotary drill bit of claim 19, further comprising at least one secondary recess formed in an upper portion of a raised section of at least one of the first ring pattern and the at least a second ring pattern.

31. The rotary drill bit of claim 19, wherein the substrate has a longitudinal axis, and wherein each groove of the at least a second ring pattern is defined as the area of the interface between a first path extending substantially radially outward from the longitudinal axis along the interface through a point on a first raised section of the at least a second ring pattern and a second path extending substantially radially outward from the longitudinal axis along the interface through a point on a second raised section of the at least a second ring pattern, the first raised section and the second raised section comprising circumferentially adjacent sections of the at least a second ring pattern, the point on the first raised section and the point on the second raised section comprising circumferentially nearest points of the first raised section and the second raised section.

32. The rotary drill bit of claim 19, wherein the substrate is substantially cylindrical and the first ring pattern and the at least a second ring pattern extend from a substantially planar end surface of the substrate.

33. The rotary drill bit of claim 19, wherein the substrate comprises an elongated body with a domed end surface and the first ring pattern and the at least a second ring pattern extend from the domed end surface.

34. The rotary drill bit of claim 19, wherein each of the first ring pattern and the at least a second ring pattern are arranged in one of a substantially circular, a substantially elliptical, or a ring-like fashion.

35. The rotary drill bit of claim 19, wherein the first ring pattern and the at least a second ring pattern are concentric.

36. The rotary drill bit of claim 19, wherein the superabrasive material comprises polycrystalline diamond.

37. A cutting element for use on a tool for forming a borehole in a subterranean formation, comprising:

a substrate having a layer of superabrasive material disposed on an end surface thereof, wherein an interface between the substrate and the layer of superabrasive material comprises:

a plurality of ring patterns, each ring pattern of the interface including an odd number of raised sections circumferentially separated by grooves.

38. The cutting element of claim 37, wherein the raised sections of each ring pattern of the plurality of ring patterns extend from the end surface of the substrate into the layer of superabrasive material.

39. The cutting element of claim 37, wherein the raised sections of each ring pattern of the plurality of ring patterns extend from a surface of the layer of superabrasive material into the substrate.

40. The cutting element of claim 37, wherein:

each of the raised sections of each ring pattern of the plurality of ring patterns is substantially identical to other raised sections in the same ring pattern.

41. The cutting element of claim 37, wherein the raised sections of each ring pattern of the plurality of ring patterns are substantially equally circumferentially spaced in relation to other raised sections in the same ring pattern.

42. The cutting element of claim 37, wherein the substrate is substantially cylindrical and each ring pattern of the plurality of ring patterns extends from a substantially planar end surface of the substrate.

43. The cutting element of claim 37, wherein the substrate comprises an elongated body with a domed end surface and each ring pattern of the plurality of ring patterns extends from the domed end surface.

44. The cutting element of claim 37, wherein each ring pattern of the plurality of ring patterns is arranged in one of a substantially circular, a substantially elliptical, and a ring-like fashion.

45. The cutting element of claim 37, wherein the superabrasive material comprises polycrystalline diamond.

46. A rotary drill bit for drilling a subterranean formation, comprising:

a bit body having a face; and at least one cutting element mounted on the face of the bit body, the at least one cutting element comprising a substrate having a layer of superabrasive material disposed on an end surface thereof;

wherein an interface between the substrate and the layer of superabrasive material comprises:

a plurality of ring patterns, each ring pattern of the interface including an odd number of raised sections circumferentially separated by grooves.

47. The rotary drill bit of claim 46, wherein the raised sections of each ring pattern of the plurality of ring patterns extend from the end surface of the substrate into the layer of superabrasive material.

48. The rotary drill bit of claim 46, wherein the raised sections of each ring pattern of the plurality of ring patterns extend from a surface of the layer of superabrasive material into the substrate.

49. The rotary drill bit of claim 46, wherein:

each of the raised sections of each ring pattern of the plurality of ring patterns is substantially identical to other raised sections in the same ring pattern.

50. The rotary drill bit of claim 46, wherein the raised sections of each ring pattern of the plurality of ring patterns are substantially equally circumferentially spaced in relation to other raised sections in the same ring pattern.

51. The rotary drill bit of claim 46, wherein the substrate is substantially cylindrical and each ring pattern of the plurality of ring patterns extends from a substantially planar end surface of the substrate.

52. The rotary drill bit of claim 46, wherein the substrate comprises an elongated body with a domed end surface and each ring pattern of the plurality of ring patterns extends from the domed end surface.

53. The rotary drill bit of claim 46, wherein each ring pattern of the plurality of ring patterns is arranged in one of a substantially circular, a substantially elliptical, and a ring-like fashion.

54. The rotary drill bit of claim 46, wherein the superabrasive material comprises polycrystalline diamond.

* * * * *

UNITED STATES PATENT AND TRADEMARK OFFICE

CERTIFICATE OF CORRECTION

PATENT NO. : 7,243,745 B2
APPLICATION NO. : 10/901836
DATED : July 17, 2007
INVENTOR(S) : Marcus R. Skeem, Danny E. Scott and Jeffrey B. Lund It is certified that error appears in the above-identified patent and that said Letters Patent is hereby corrected as shown below:

In the specification:

| | | |
|---|---|---|
| COLUMN 2, | LINE 40, | change "thereof a cutting" to --thereof, a cutting-- |
| COLUMN 5, | LINE 18, | change "FIGS. **1**A-**1**B," to --FIGS. **1**A and **1**B.-- |
| COLUMN 9, | LINE 28, | change "substrates **10** and **50**." to --substrates **10** and **60**.-- |
| COLUMN 10, | LINE 44, | change "axis of" to --axis **211** of-- |
| COLUMN 11, | LINE 13, | change "axis of" to --axis **251** of-- |
| COLUMN 13, | LINE 8, | change "substrate generally" to --substrate **410** generally-- |
| COLUMN 13, | LINE 57, | change "substrates **450** and **451**," to --substrates **470** and **471**,-- |

Signed and Sealed this
Twenty-first Day of May, 2013

Teresa Stanek Rea
*Acting Director of the United States Patent and Trademark Office*